US005649275A

United States Patent [19]

Kaneta

[11] Patent Number: 5,649,275

[45] Date of Patent: Jul. 15, 1997

[54] IMAGE FORMING APPARATUS

[75] Inventor: Satoshi Kaneta, Nagano, Japan

[73] Assignee: Seiko Epson Corporation, Tokyo, Japan

[21] Appl. No.: 609,386

[22] Filed: Mar. 1, 1996

[30] Foreign Application Priority Data

Mar. 1, 1995 [JP] Japan ..... 7-066958

[51] Int. Cl.[6] ..... G03G 15/00

[52] U.S. Cl. ..... 399/381; 399/397

[58] Field of Search ..... 399/361, 381, 399/388, 397, 405

[56] References Cited

U.S. PATENT DOCUMENTS

| | | | |
|---|---|---|---|
| Re. 34,948 | 5/1995 | Aizawa et al. | 347/138 |
| 4,727,387 | 2/1988 | Israely | 346/160 |
| 5,065,197 | 11/1991 | Mitsuyama | 355/309 |
| 5,253,028 | 10/1993 | Gonda et al. | 271/9 |
| 5,276,469 | 1/1994 | Beaufort et al. | 346/153.1 |
| 5,386,283 | 1/1995 | Yang et al. . | |
| 5,485,990 | 1/1996 | Kato | 271/9.08 |

FOREIGN PATENT DOCUMENTS

| | | | |
|---|---|---|---|
| A1240272 | 10/1986 | Germany | G03G 15/00 |
| 6202390 | 7/1994 | Japan | G03G 15/00 |
| 6202395 | 7/1994 | Japan | G03G 15/00 |

OTHER PUBLICATIONS

Patent Abstracts of Japan, vol. 018, No. 557 (P-1817), 24 Oct. 1994, & JP-A-06 202390 (Canon Inc) Jul. 22, 1994, *abstract.

Patent Abstracts of Japan, vol. 018, No. 557 (P-1817), 24 Oct. 1994, & JP-A-06 202395 (Canon Inc) Jul. 22, 1994, *abstract.

Patent Abstracts of Japan, vol. 018, No. 279 (M-1612), May 27, 1994, & JP-A-06 048593 (Ricoh Co Ltd) Feb. 22, 1994, *abstract.

*Primary Examiner*—R. L. Moses

*Attorney, Agent, or Firm*—Sughrue, Mion, Zinn, Macpeak & Seas

[57] ABSTRACT

Paper feeding roller, image forming means, fixing means, paper discharging means, and a sheet guide are all slanted from the vertical direction. Support means, which supports the printed sheet discharged from the paper discharging means in a state that it is slanted from the vertical direction to the inside of the image forming apparatus, is formed by the side portion of the case. The lower-edge support for supporting the lower edge of the discharged sheet is positioned at a level that is higher than the lower edge of the sheet to be fed. The slanting angle of the support means is selected to have such a value as to prevent the sheet from slipping down from the support means when the image forming apparatus is laid down.

24 Claims, 9 Drawing Sheets

IMAGE FORMING APPARATUS

BACKGROUND OF THE INVENTION

1. Field of the Invention

The present invention relates to an image forming apparatus, such as a printer, a copying machine, or a facsimile machine. More particularly, the invention relates to an image forming apparatus which occupies a reduced area in a place where it is installed for use.

2. Description of the Prior Art

In the general image forming apparatus, a sheet on which an image is to be formed is transported in a horizontal state. Accordingly, the image forming apparatus occupies a large area in the place where it is installed.

The image forming apparatus designed for the purpose of reducing the area occupied by the apparatus is disclosed in Japanese Patent Publication Nos. Hei. 6-202390 and 6-202395.

FIG. 7 is a perspective view showing the layout of components parts within an image forming apparatus disclosed in Japanese Patent Publication No. Hei. 6-202390. FIG. 8 is a top view of the image forming apparatus of FIG. 7.

As seen from these figures, a sheet container 1, a paper feeding roller 2, a sheet transporting path 3, an image forming unit 4, a fixing unit 5, an exit roller pair 6, and the like are disposed substantially erectly within a case of the apparatus. A sheet S is transported while standing substantially upright.

With such a construction, the image forming apparatus may be vertically set when it is installed. As a result, the apparatus installing area is reduced.

FIG. 9 is a perspective view showing the layout of components parts within an image forming apparatus disclosed in Japanese Patent publication No. Hei. 6-202395. FIG. 10 is a perspective view showing a discharging state of printed sheets S.

As seen from these figures, a paper cassette 1', a paper feeding roller 2', a photoreceptor drum 4', a fixing roller pair 5', and the like stand substantially erect, so that a sheet S is transported while standing substantially upright.

An exit roller pair 6' is mounted slantwise. With the slant, the discharged sheets S are brought down in the slanting direction and laid upon another successively, as shown in FIG. 10.

In the publication (Japanese Patent publication No. Hei. 6-202395), the exit roller pair 6' stands substantially erect, and a tray 7 for receiving discharged sheets S is provided, as shown in FIG. 11.

In the apparatus disclosed in published Unexamined Japanese Patent Application No. Hei. 6-202390, the sheet S is transported while standing substantially erect. The sheets, which are put in the sheet container 1, stand substantially upright. In the container, a part of each sheet is pressed by the paper feeding roller 2, while the remaining part of the sheet is free. Accordingly, the remaining part thereof is tiltable to the right or the left, viz., unstable. The sheet being transported along the sheet transporting path 3 is unstable, viz., swingable to the right and the left.

The sheet has a toner image transferred thereto by the image forming unit 4. If the sheet vibrates during the course of the movement of the sheet up to the fixing unit 5, toner of the toner image is shaken from the sheet (the toner image will get out of shape). Therefore, the resultant image will be poor in quality.

In the conventional apparatus, between the image forming unit 4 and the fixing unit 5, the sheet is transported in a state that only the end of the sheet is held between a sheet transporting belt 8, which comes in contact with the toner transferred surface of the sheet, and a guide plate 9. In such a construction, the sheet transporting belt 8 and its drive system are indispensably provided. The result is a complexity of the sheet transporting means.

Although not described in the publication, the sheet transporting belt 8 for holding the end part of the toner transferred surface of the sheet is allowed to be provided for only the lower end part of the sheet. Accordingly, the upper end part of the sheet still vibratory, and there is the possibility that the toner image will be lost in its shape. An additional sheet transporting belt 8 may be provided for the upper part of the sheet. However, this structure cannot support the sheet of different size. To cope with this, the upper sheet transporting belt may be mounted vertically movably. However, this approach makes the related structure more complicated.

The same thing is true for the apparatus described in Japanese Patent Publication No. Hei. 6-202395.

In either conventional apparatus, the sheet S is transported in a state that it stands upright. The behavior of the sheet S is unstable, and hence its handling is difficult.

The handling of the sheets discharged by the exit roller pair 6 is not described in Japanese Patent Publication No. Hei. 6-202395.

In the apparatus of the publication, the sheets are discharged to be scattered on the apparatus installing place. In those scattered sheets, some sheets are faced up and some sheets are faced down.

A solution to the scattering problem is disclosed in Japanese Patent Publication No. Hei. 6-202395.

In a first solution, as shown in FIG. 10, an exit roller pair 6' is mounted slantwise. The discharged sheets S are successively laid upon another successively on the installing place. In a second solution, as shown in FIG. 11, the exit roller pair 6' stands erect, not slanted, and a tray 7 receives discharged sheets S.

In the first solution shown in FIG. 10, the printed surfaces of the discharged sheets S are all turned upward (faced up), but the edges of the sheets are not trued up. Further, the discharged sheets are laid upon another on the installing place. A large area in the installing place is occupied when the apparatus is used. This is adverse to the object to reduce the area occupied by the apparatus.

In the second solution shown in FIG. 11, the printed surfaces of the discharged sheets are all faced up, and the edges of the sheets are trued up.

The discharged sheet tray 7 is slanted to the outside of the apparatus (turned counterclockwise in FIG. 11), and provided on the front side of the apparatus case. Accordingly, the area occupied by the apparatus is increased, and this fact is also adverse to the object to reduce the occupied area.

SUMMARY OF THE INVENTION

An object of the present invention is to provide an image forming apparatus which reduces an area occupied by the image forming apparatus in a place where it is installed, and provides an easy handling of sheets.

As viewed from a first aspect of the invention, there is provided an image forming apparatus comprising: image forming means for forming an image on a sheet; paper feeding means for feeding the sheet to the image forming means; paper discharging means for discharging the sheet having the image formed thereon by the image forming means; and a sheet guide for guiding the sheet; wherein the image forming means, the paper feeding means, the paper discharging means and the sheet guide are all slanted from the vertical direction.

As viewed from a second aspect of the invention, there is provided an image forming apparatus comoprising: image forming means for forming a toner image on a sheet; paper feeding means for feeding a sheet to the image forming means; fixing means for fixing the formed toner image onto the sheet; paper discharging means for discharging the sheet having the toner image fixed thereon by the fixing means; and a sheet guide for guiding the sheet in a state that the sheet guide is in contact with the reverse side of the sheet having no toner image; wherein the image forming means, the paper feeding means, the fixing means, the paper discharging means, and the sheet guide are all slanted from the vertical direction.

As viewed from a third aspect of the invention, the sheet is fed to the rear side of the image forming apparatus by the paper feeding means, is reversed while being guided by the sheet guide, and discharged from the front side of the image forming apparatus by the paper discharging means according to the first and second aspects of the invention.

As viewed from a fourth aspect of the invention, the image forming apparatus further comprising: support means for supporting the printed sheet discharged from the paper discharging means in a state that the sheet is slanted to the inside of the image forming apparatus from the vertical direction according to the third aspect of the invention.

As viewed from a fifth aspect of the invention, the image forming means, the paper feeding means, the paper discharging means and the sheet guide are put in a box-like case and the support means is formed by the side portion of the case according to the fourth aspect of the invention.

As viewed from a sixth aspect of the invention, the image forming means, the paper feeding means, the paper discharging means and the sheet guide are put in a box-like case, the upper side of a sheet transporting path for the sheet guided by the sheet guide intersects the ceiling plate of the case, a releasing slit is provided downstream of the intersection of the ceiling plate when viewed in the sheet transporting direction, the support means-includes a lower-edge support for supporting the lower edge of the sheet discharged by the paper discharging means, and the upper surface of the lower-edge support is positioned at a level higher than the lower edge of the sheet to be fed by the paper feeding means according to the fourth aspect of the invention.

As viewed from a seventh aspect of the invention, the slanting angle of the support means is selected to have such a value as to prevent the sheet from slipping down from the support means when the image forming apparatus is laid down according the fourth aspect of the invention.

As viewed from a eighth aspect of the invention, the image forming means, the paper feeding means, the paper discharging means, and the sheet guide are put in a box-like case, the ceiling plate of the case intersects the upper side of a sheet transporting path for the sheet guided by the sheet guide, a releasing slit is provided upstream of the intersection of the ceiling plate when viewed in the sheet transporting direction, and paper supply/support means for supporting sheets to be fed by the paper feeding means in a state that the sheet is slanted to the inside of the image forming apparatus, from the vertical direction according to the third aspect of the invention.

As viewed from a ninth aspect of the invention, the support means is formed by the side portion of the case according to the eighth aspect of the invention.

As viewed from a tenth aspect of the invention, the slanting angle of the supply/support means is selected to have such a value as to prevent the sheet from slipping down from the supply/support means when the image forming apparatus is laid down according to the eighth aspect of the invention.

The image forming apparatus according to the first aspect of the invention has image forming means for forming an image on a sheet, paper feeding means for feeding a sheet to the image forming means, paper discharging means for discharging the sheet having the image formed thereon by the image forming means, and a sheet guide for guiding the sheet. Accordingly, the sheet is fed to the image forming means by the paper feeding means, an image is formed by the image forming means, and the sheet bearing the image formed thereon is discharged by the paper discharging means.

The paper feeding means, the image forming means, the paper discharging means, and the sheet guide are all slanted from the vertical direction. Therefore, the sheet is moved in a state that it leans on those means and the sheet guide.

As a result, the behavior of the sheet is stable, and the handling of the sheets is easy.

Further, in the image forming apparatus, the paper feeding means, the image forming means, the paper discharging means, and the sheet guide are all slanted from the vertical direction. The area occupied by the apparatus in its installing place may be increased when comparing with the image forming apparatus in which the related means stands upright (FIGS. 7 and 9).

However, the area occupied by the apparatus is reduced to the extent of the slant of those means and the sheet guide, when comparing with the general image forming apparatus of the type in which the sheet is moved in a horizontal state.

Thus, the image forming apparatus as viewed from the first aspect of the invention reduces the area occupied by the apparatus, when comparing with the general image forming apparatus of the type in which the sheet is moved in a horizontal state. Further, the behavior of the sheet is more stable and the handling of the sheets is easier than in the conventional apparatuses of FIGS. 7 and 8.

The image forming apparatus according to the second aspect of the invention has image forming means for forming a toner image on a sheet, paper feeding means for feeding a sheet to the image forming means, fixing means for fixing the formed toner image onto the sheet, paper discharging means for discharging the sheet having the toner image fixed thereon by the fixing means, and a sheet guide for guiding the sheet in a state that the sheet guide is in contact with the reverse side of the sheet having no toner image. Accordingly, the sheet is fed to the image forming means by the paper feeding means, a toner image is formed by the image forming means, the toner image is fixed onto the sheet by the fixing means, and the sheet bearing the image formed thereon is discharged by the paper discharging means.

The paper feeding means, the image forming means, the fixing means, the paper discharging means, and the sheet guide are all slanted from the vertical direction. Therefore, the sheet is moved in a state that it leans on those means and the sheet guide. As a result, the behavior of the sheet is stable.

The sheet is moved in a state that the reverse side of the sheet where no toner image is formed leans on the sheet guide. Such an unwanted situation that the toner image comes in contact with the sheet guide to get out of shape does not take place. Further, the behavior of the sheets is stable, and hence the vibration of the sheets is remarkably reduced. Further, the shaking of toner from the sheet is lessened to the extent of the slant of the sheet.

A better image is formed by the apparatus of the invention than by the conventional apparatuses of FIGS. 7 and 9.

Since the sheet is moved in a state that the reverse side of the sheet where no toner image is formed leans on the sheet guide, there is no need of using the sheet transporting belt that is indispensable for the conventional apparatus shown in FIG. 7. Accordingly, the apparatus structure is simplified, and the apparatus is able to print an image on the sheets of different width (height).

The image forming apparatus as viewed from the second aspect of the invention more reduces the-area occupied by the apparatus than the general image forming apparatus of the type in which the sheet is moved in a horizontal state. Further, the apparatus produces a better image than the conventional apparatuses of FIGS. 7 and 9. Additionally, the apparatus prints an image on the sheets of different width (height), with a simple structure.

The image forming apparatus according to the third aspect of the invention is constructed such that the sheet is fed to the rear side of the image forming apparatus by the paper feeding means, is reversed while being guided by the sheet guide, and discharged from the front side of the image forming apparatus by the paper discharging means. Accordingly, the user can supply the sheets to the printer and take the printed sheets out of the printer at the front side thereof. An access to the printer is easy.

The image forming apparatus according to the fourth aspect of the invention is construction such that the apparatus further comprises support means for supporting the printed sheet discharged from the paper discharging means in a state that the sheet is slanted to the inside of the image forming apparatus from the vertical direction. With provision of the support means, the discharged sheets are supported in a state that these are slanted to the inside of the apparatus.

Accordingly, the discharged sheets are not scattered on the installing place, although these are scattered in the conventional apparatus shown in FIG. 10.

Additionally, the support means, unlike the tray 7 for receiving the printed sheets shown in FIG. 11, is constructed so as to support the printed sheets in a state that these are slanted to the inside of the printer. Accordingly, the area occupied by the printer when it is installed is reduced.

The image forming apparatus according to the fifth aspect of the invention is constructed such that the image forming means, the paper feeding means, the paper discharging means, and the sheet guide are put in a case shaped like a box, and the support means is formed by the side portion of the case. Accordingly, the area occupied by the printer when it is installed is further reduced when comparing with the conventional apparatus (FIG. 11) in which the tray 7 is provided on the front side of the case.

The image forming apparatus according to the sixth aspect of the invention is constructed such that the image forming means, the paper feeding means, the paper discharging means, and the sheet guide are put in a box-like case, the upper side of a sheet transporting path for the sheet guided by the sheet guide intersects the ceiling plate of the case, a releasing slit is provided downstream of the intersection of the ceiling plate when viewed in the sheet transporting direction, the support means includes a lower-edge support for supporting the lower edge of the sheet discharged by the paper discharging means, and the upper surface of the lower-edge support is positioned at a level higher than the lower edge of the sheet to be fed by the paper feeding means. The image forming apparatus thus constructed operates as follows.

The image forming means, the paper feeding means, the paper discharging means, and the sheet guide, which are put in a case, are all slanted from the vertical direction. Accordingly, the sheet is transported toward the rear side of the printer, by the paper feeding means, and then it reverses its course while being guided by the sheet guide. Finally, it is discharged from the front side of the printer, by the paper discharging means. Accordingly, the sheet gradually ascends at the reversing position.

The upper side of a sheet transporting path for the sheet guided by the sheet guide intersects the ceiling plate of the case, and the releasing slit is provided downstream of the intersection of the ceiling plate when viewed in the sheet transporting direction. When the height (width) of the sheet is higher than a preset value of height, the upper side of the sheet gradually ascends above the case through the releasing slit. After the sheet is reversed, the upper side of the sheet is positioned, over its entire length (the length thereof extended in the transporting direction), above the ceiling plate of the case.

The sheet that is discharged in this state is supported at its lower edge by the lower-edge support of the support means. The upper surface of the lower-edge support is positioned above the lower edge of the sheet to be fed by the paper feeding means. Accordingly, the upper side of the discharged sheet is held in a state that it is positioned above the ceiling plate of the case.

Accordingly, the user easily picks up the upper side or sides of the discharged sheet or sheets with his fingers.

The image forming apparatus according to the seventh aspect of the invention is constructed such that the slanting angle of the support means is selected to have such a value as to prevent the sheet from slipping down from the support means when the image forming apparatus is laid down. Accordingly, the image forming apparatus may also be used in a state that it is laid down.

The image forming apparatus according to the eighth aspect of the invention is constructed such that in the image forming apparatus as set forth in the third aspect of the invention, the image forming means, the paper feeding means, the paper discharging means, and the sheet guide are put in a box-like case, the ceiling plate of the case intersects the upper side of a sheet transporting path for the sheet guided by the sheet guide, a releasing slit is provided upstream of the intersection of the ceiling plate when viewed in the sheet transporting direction, and paper supply/support means for supporting sheets to be fed by the paper feeding means in a state that the sheet is slanted to the inside of the image forming apparatus from the vertical direction. The image forming apparatus thus constructed operates as follows.

The image forming means, the paper feeding means, the paper discharging means, and the sheet guide, which are put in a case, are all slanted from the vertical direction. Accordingly, the sheet is transported toward the rear side of the printer, by the paper feeding means, and then it reverses its course while being guided by the sheet guide. Finally, it is discharged from the front side of the printer, by the paper discharging means. Accordingly, the sheet gradually descends at the reversing position.

The ceiling plate of the case intersects the upper side of the sheet transporting path. The releasing slit is provided upstream of the intersection of the ceiling plate when viewed in the sheet transporting direction. The paper supply/support means is provided upstream of the intersection when viewed in the sheet transporting direction. The sheet, which is supplied from the paper supply/support means, gradually enters the case, from the releasing slit. After the sheet is reversed, the sheet has been put, over its entire length (the length thereof extended in the transporting direction), in the case.

In a case where the height (width) of the sheet, which is fed in such a state, is higher than a preset value of height, the upper side of the discharged sheet is held in a state that it is positioned above the ceiling plate of the case, when it is supported by the paper supply/support means.

Accordingly, the user may easily set the sheet to the paper supply/support means by pinching the upper side of the sheet with his fingers.

The area occupied by the printer is reduced since the paper supply/support means supports the sheets in a state these are slanted to the inside of the apparatus from the vertical direction.

The image forming apparatus according to the ninth aspect of the invention is constructed such that the support means is formed by the side portion of the case. Accordingly, the area occupied by the printer is further reduced.

The image forming apparatus according to the tenth aspect of the invention is constructed such that the slanting angle of the supply/support means is selected to have such a value as to prevent the sheet from slipping down from the supply/support means when the image forming apparatus is laid down. Accordingly, the image forming apparatus may also be used in a state that it is laid down.

DETAILED DESCRIPTION OF THE PREFERRED EMBODIMENTS

The preferred embodiments of the present invention will be described with reference to the accompanying drawings.

1st Embodiment

Figure 1:
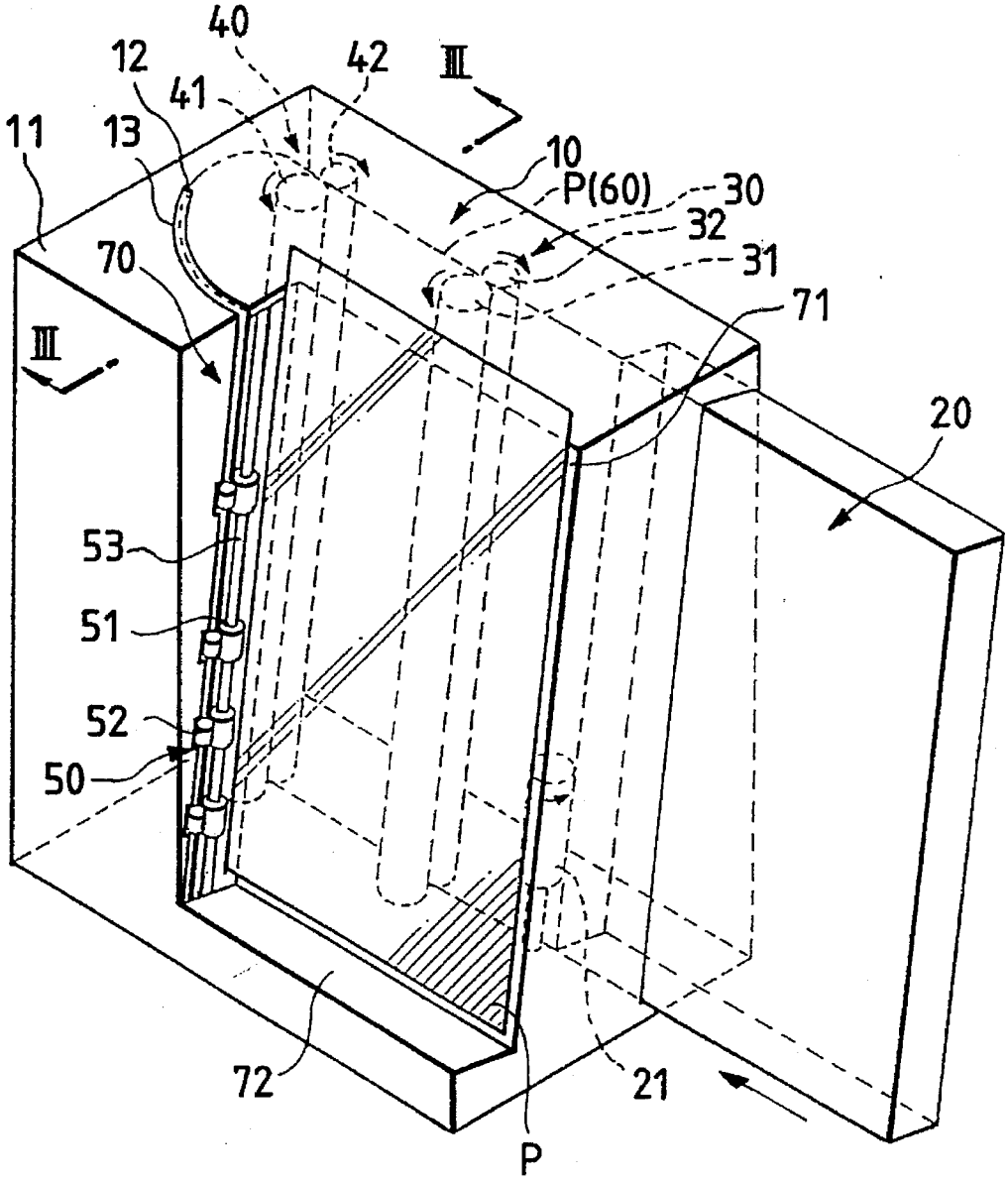
FIG. 1 is a perspective view showing an image forming apparatus according to a first embodiment of the present invention, the image forming apparatus being expressed in the form of a xerography-basis printer.
Figure 2:
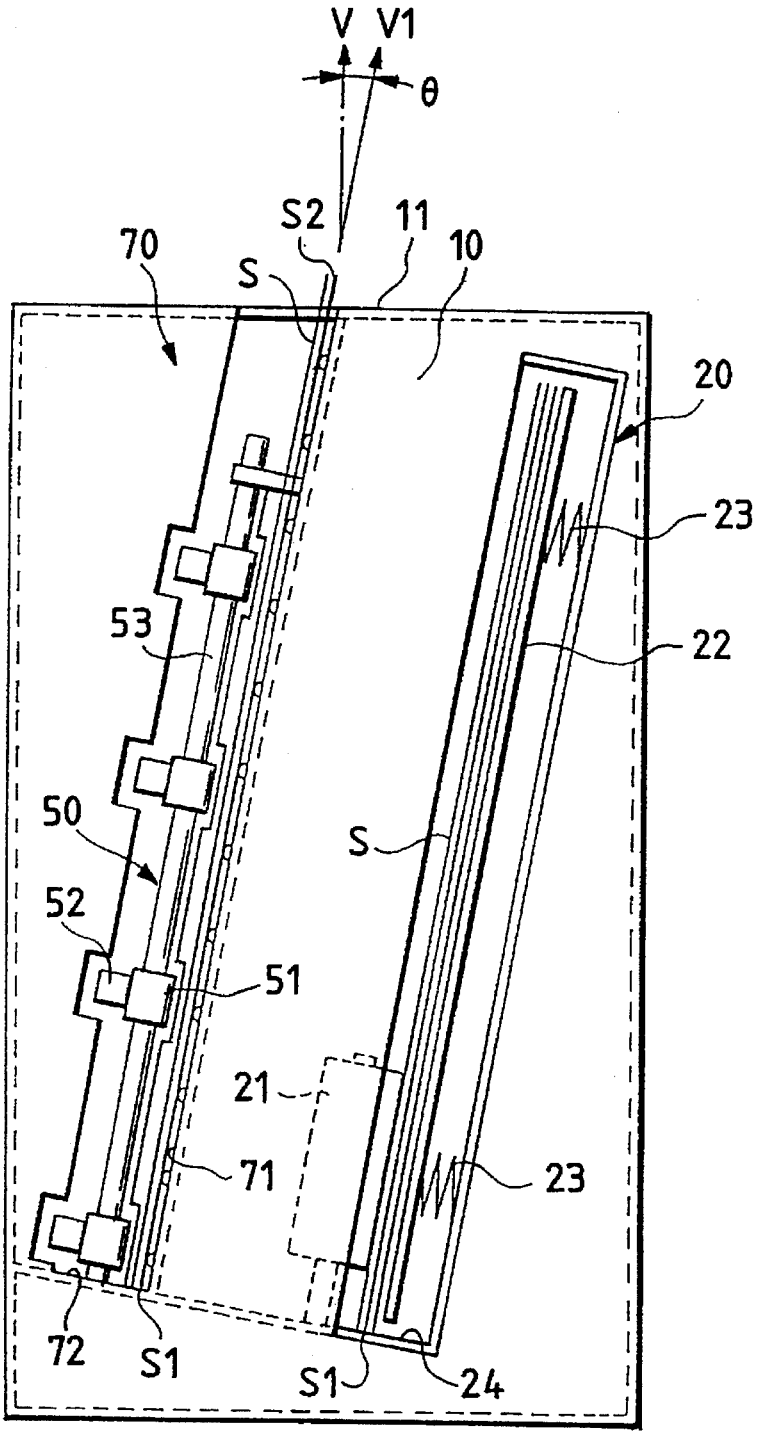
FIG. 2 is a front view showing the xerography-basis printer of FIG. 1.
Figure 3:
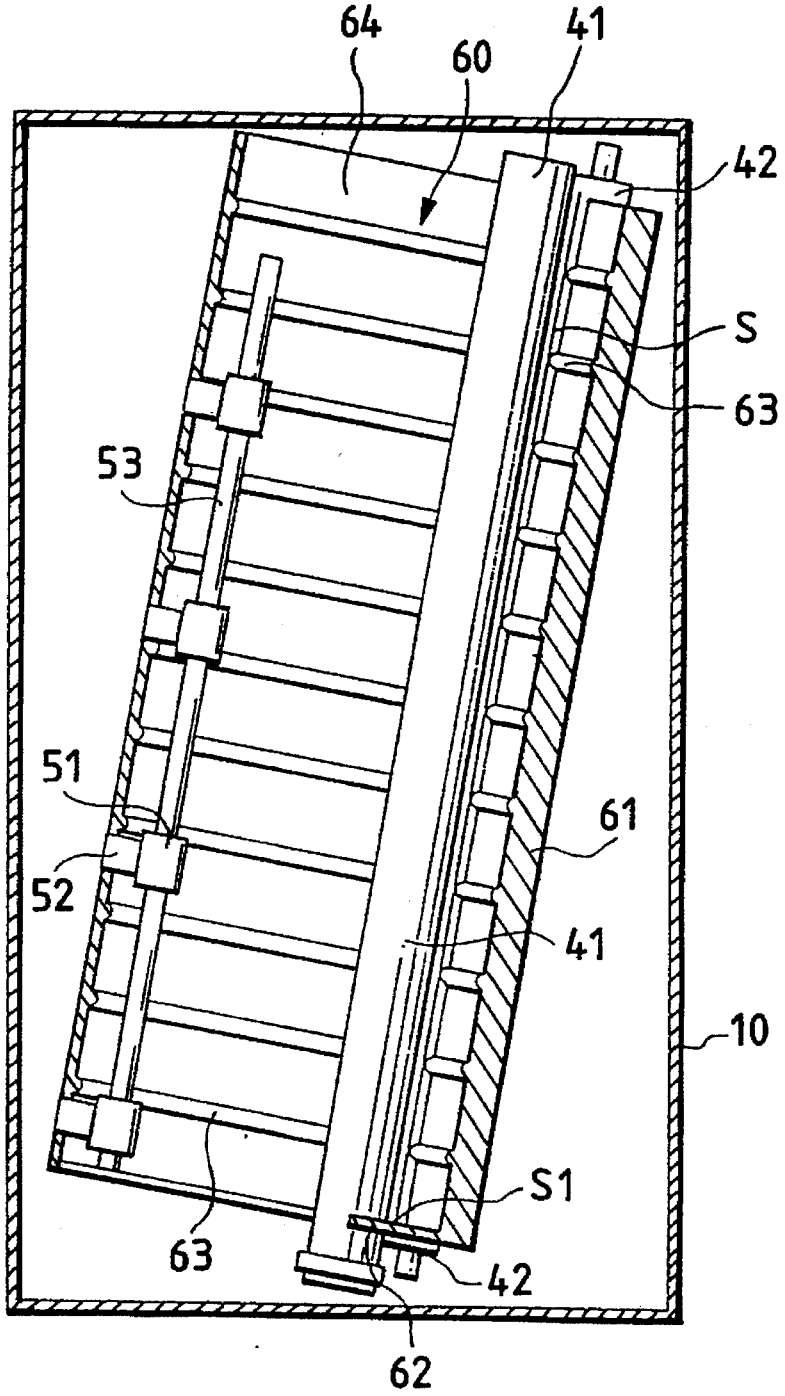
FIG. 3 is a cross sectional view taken along line III—III in FIG. 1.
Figure 4:
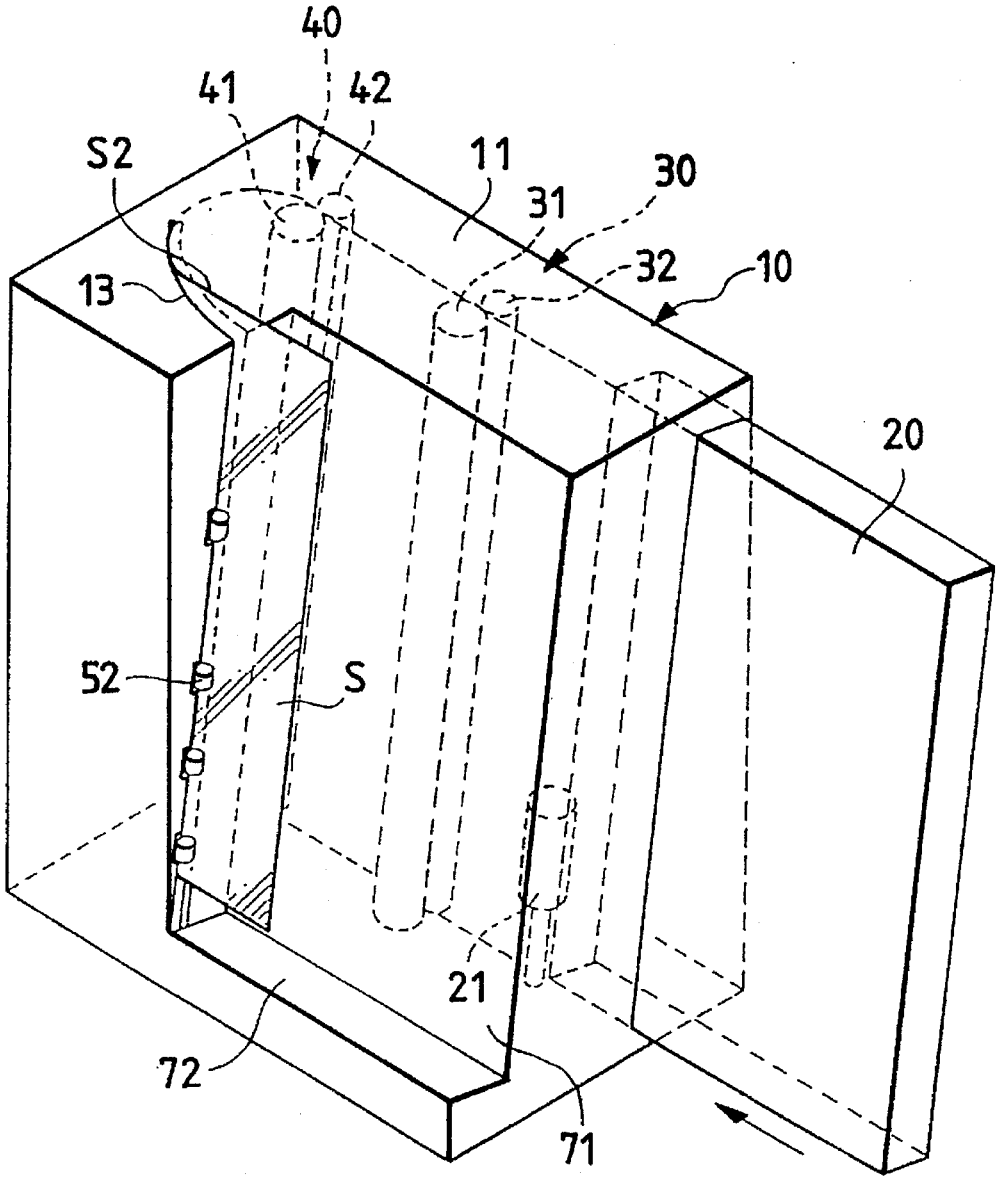
FIG. 4 is a perspective view showing the xerography-basis printer of FIG. 1, useful in explaining the operation of the printer.

FIG. 1 is a perspective view showing an image forming apparatus according to a first embodiment of the present invention. In the first embodiment, the image forming apparatus is expressed in the form of a xerography-basis printer. FIG. 2 is a front view showing the xerography-basis printer of FIG. 1. FIG. 3 is a cross sectional view taken along line III—III in FIG. 1.

In these figures, reference numeral 10 designates a case of the printer. The case takes the form of a longitudinal box.

Reference numeral 20 designates a paper cassette, which contains a plural number of sheets S therein. The paper cassette 20 is removably set to the case 10. The sheets S are normal papers of A4 size, for example, in the present embodiment.

Numeral 21 designates a paper feeding means, which is constructed with a paper feed roller. A hopper 22 is provided within the paper cassette 20, as shown in FIG. 2. The hopper 22 urges the sheets toward the paper feeding roller 21. With the aid of the hopper 22, the sheets are fed to the printer sheet by sheet. Numeral 23 indicates compressed springs for urging the hopper 22.

Numeral 30 stands for image forming means. The image forming means 30 forms an image on a sheet S by using a known image forming process. Numeral 31 represents a photoreceptor in the form of a drum. The surface of the photoreceptor drum 31 is scanned with a laser beam (not shown). An electrostatic latent image is formed on the surface of the photoreceptor drum 31. The latent image is developed, by developing means (not shown), into a toner image. Numeral 32 designates an image transfer roller. The image transfer roller 32 transfers the toner image from the surface of the photoreceptor drum 31 onto a sheet.

Numeral 40 is representative of fixing means. The fixing means 40 includes a fixing roller 41 containing a heating source and a pressure roller 42.

Numeral 50 designates paper discharging means. The paper discharging means 50 includes a drive roller 51 and a follower roller 52. The drive roller 51 is fixed to a shaft 53. The follower roller 52 is rotatably supported by the case 10, and turned in a state that it is pressed against the drive roller 51.

The paper feeding roller 21, the image forming means 30, the fixing means 40, and the paper discharging means 50 are put in the case. Those means are turned by drive means (not shown).

In FIG. 3, numeral 60 designates a sheet guide. The sheet guide 60 includes a reverse-side guide 61 for receiving the reverse side of the sheet and guiding the sheet forward, and a lower-edge guide 62 for receiving the lower edge of the sheet and guiding the sheet forward. Numeral 63 designates ribs formed on the guide surface of the reverse-side guide 61. In FIG. 1, a broken line P indicates a sheet transporting path for the sheet guided by the sheet guide 60. The sheet guide 60 is extended between the paper feeding roller 21 and the image forming means 30, the image forming means 30 and the fixing means 40, and the fixing means 40 and the paper discharging means 50. The sheet guide 60 is curved between the fixing means 40 and the paper discharging means 50.

Reference numeral 70 indicates a support means for supporting the discharged sheet. The support means 70, which is formed by the partially cut faces of the side portion of the case 10 per se, includes a surface support 71 for supporting the obverse side (side an image formed thereon) of the sheet S, and a lower-edge support 72 for supporting the lower edge S1 of the sheet S. The upper surface of the lower-edge support 72, as seen from FIG. 2, is positioned at a level higher than the lower edge S1 of the sheet to be fed by the paper feeding means 21.

As seen from FIGS. 1 and 2, the paper cassette 20, the paper feeding roller 21, the image forming means 30, the fixing means 40, the paper discharging means 50, the sheet guide 60, and the support means 70 are all slanted at an angle θ (in the direction of an arrow V1) from the vertical direction (of an arrow V in FIG. 2). The angle θ of the support means 70 is selected to have such a value as to prevent the sheet S from slipping down from the support means 70 when the printer is set down on its side (turned clockwise by 90° in FIG. 2). The angle is substantially determined by frictional forces between the surface support 71 and the sheet, and between the sheets. Usually, the angle θ is 10° or smaller, preferably 5° or smaller. Approximately 5° is the most preferable angle since the behavior of the sheet is more unstable as the slanting angle becomes smaller.

Since the image forming means 30, the fixing means 40, the sheet guide 60, and the like are slanted, the transporting sheet gradually ascends at its reversing position (at a curved portion 64 of the sheet guide 60).

In the present embodiment, as shown in FIG. 1, the upper side of the sheet transporting path P intersects the ceiling plate 11 of the case 10 (the intersection is designated by numeral 12). A curved releasing slit 13 is provided downstream of the intersection 12 of the ceiling plate 11 when viewed in the sheet transporting direction. The releasing slit 13 leads to the support means 70.

The operation of the printer thus constructed will be described.

The paper cassette 20 containing the sheets S is loaded into the case 10. The sheets S are fed sheet by sheet to the rear side of the printer by the paper feeding roller 21.

The paper cassette 20 is loaded into the case in a state that it is slanted as shown in FIGS. 1 and 2. The sheets S are also slanted. When the paper cassette 20 is loaded into the case 10, the lower edges S1 of the sheets S are put on the bottom 24 of the paper cassette 20 and automatically trued up. Therefore, there is eliminated the user's work to true up the edges of a stack of sheets S. Further, the stack of the sheets S are set leaning on the hopper 22 within the paper cassette 20, so that the sheets S are stably supported and hence stably transported by the paper feeding roller 21.

The sheet S that is fed by the paper feeding roller 21 is guided by the sheet guide 60 and reaches the image forming means 30.

As shown in FIG. 3, in the transportation of the sheet S, the lower edge S1 of the sheet S is guided by the lower-edge guide 62 of the sheet guide 60 in a state that the reverse side of the sheet S leans on the reverse-side guide 61. Accordingly, the sheet S is stably transported.

When the sheet S arrives at the image forming means 30, it passes the nip between the photoreceptor drum 31 and the image transfer roller 32. At this time, a toner image formed on the surface of the photoreceptor drum 31 is transferred onto the surface of the sheet S.

The sheet S having a toner image formed thereon is transported forward under the drive by the image forming means 30. In the transportation, it is guided by the sheet guide 60 and reaches the fixing means 40.

Thus, in the transportation of the sheet S, the lower edge S1 of the sheet S is guided by the lower-edge guide 62 of the sheet guide 60 in a state that the reverse side of the sheet S leans on the reverse-side guide 61. Accordingly, the sheet S is stably transported.

It is noted that the sheet S is moved in a state that the reverse side of the sheet S having no image formed thereon leans on the sheet guide 60. Therefore, there never occurs such an unwanted situation that the toner image comes in contact with the sheet guide 60, to thereby get out shape. Further, the behavior of the moving sheet S is stable, so that its vibration is lessened so much. Additionally, it is slanted, thereby shaking a reduced amount of toner therefrom.

Accordingly, the toner image will never get out of shape during the course of the movement of the sheet up to the fixing means 40.

Figure 7:
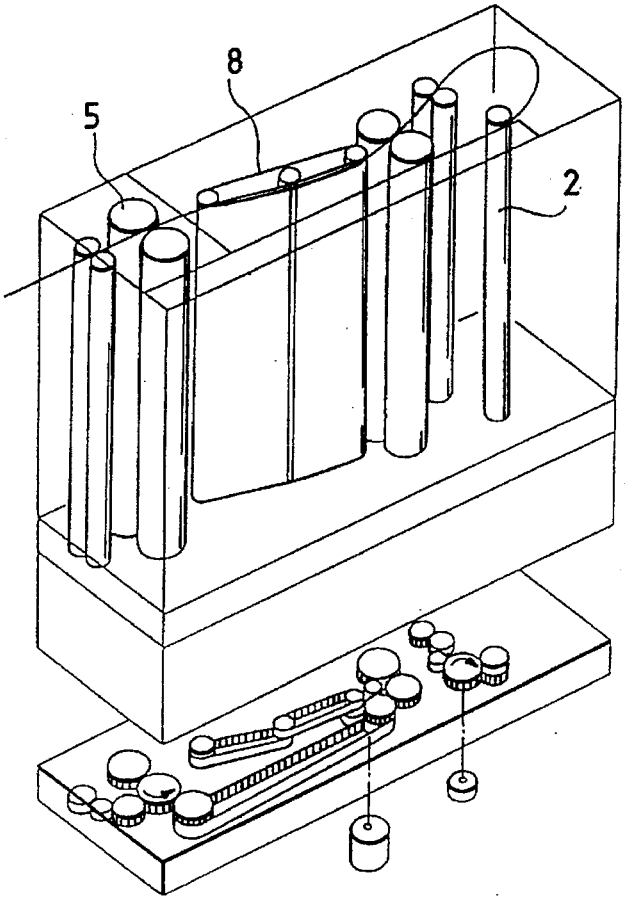
FIG. 7 PRIOR ART
FIG. 7 is an explanatory diagram for explaining a conventional art.

The sheet S is transported in a state that the reverse side of the sheet S having no image formed thereon leans on the reverse-side guide 61. Therefore, there is no need of the sheet transporting belt that is indispensable for the conventional apparatus shown in FIG. 7. Therefore, the structure of the printer is simplified, and an image may be printed on a sheet of the different width (height) (e.g., a sheet of B5 size).

The sheet S having the toner image fixed thereon is transported by the drive force from the image forming means 30 and/or the fixing means 40, and then guided and reversed by the curved portion 64 of the sheet guide 60, and reaches the paper discharging means 50.

The sheet S is guided by the curved portion 64 of the sheet guide 60 and gradually ascends during the course of its movement to the paper discharging means 50, and the upper side S2 of the sheet S gradually appears outside the case 10 through the releasing slit 13 while being directed upward.

At the paper discharging means 50, the sheet S is transported by the drive force from the fixing means 40 and/or the paper discharging means 50. After the sheet S is reversed, the upper side S2 of the sheet is positioned, over its entire length (the length thereof extended in the transporting direction), above the ceiling plate 11 of the case 10.

The sheet S that is discharged in this state, as shown in FIG. 2, is supported at its lower edge S1 by the lower-edge support 72 of the support means 70. At this time, its surface rests on the surface support 71. That is, it is supported in a called face-down state. The lower edge S1 of the sheet S is brought into the lower-edge support 72. Accordingly, the lower edges of the sheets S discharged are automatically trued up, thereby eliminating the user's work to true up the edges of the printed sheets.

The upper surface of the lower-edge support 72 is positioned above the lower edge of the sheet to be fed by the paper feeding roller 21. Therefore, the upper side S2 of the discharged sheet S is held in a state that it is positioned above the ceiling plate 11 of the case 10.

Accordingly, the user easily picks up the upper side S2 of the discharged sheet or sheets with his fingers.

The xerography-basis printer thus constructed and operated has the following useful effects.

Figure 8:
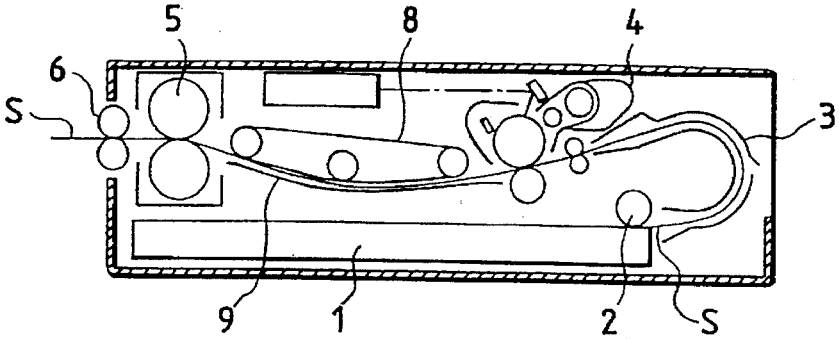
FIG. 8 PRIOR ART
FIG. 8 is an explanatory diagram for explaining the conventional art.
Figure 9:
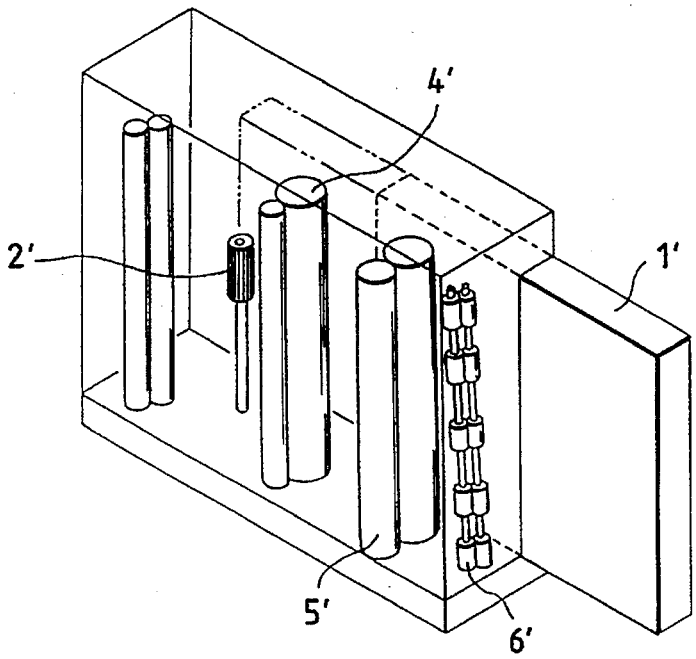
FIG. 9 PRIOR ART
FIG. 9 is an explanatory diagram for explaining another conventional art.

The paper cassette 20, the paper feeding roller 21, the image forming means 30, the fixing means 40, the paper discharging means 50, and the sheet guide 60 are all slanted from the vertical direction. The area occupied by the printer in a place where the printer is installed is reduced to the extent of the slant of those means and the sheet guide, when comparing with the general image forming apparatus of the type in which the sheet is moved in a horizontal state. Further, the behavior of the sheet is stable and the handling of the sheets is easier than in the conventional apparatuses of FIGS. 7 and 8.

The sheet is transported toward the rear side of the printer, by the paper feeding roller 21, and then it is reversed while being guided by the sheet guide 60. Finally, it is discharged from the front side of the printer, by the paper discharging means 50. Accordingly, the user can supply the sheets to the printer and take the printed sheets out of the printer at the front side. Therefore, an easy access to the printer is realized.

Figure 10:
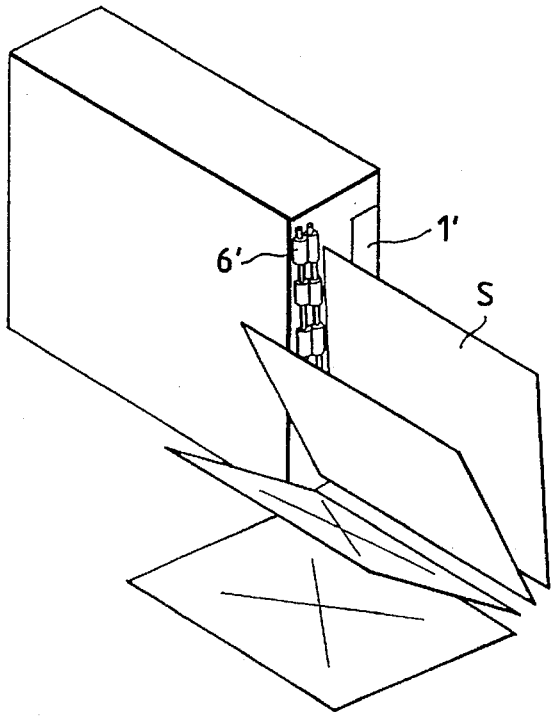
FIG. 10 PRIOR ART
FIG. 10 is an explanatory diagram for explaining the conventional art.

The support means 70 is provided. The support means 70 supports the sheets, that is discharged by the paper discharging means 50, in a state that they are slanted to the inside of the printer from the vertical direction. With provision of the support means 70, the discharged sheets are not scattered on the installing place, although these are scattered in the conventional apparatus shown in FIG. 10.

Figure 11:
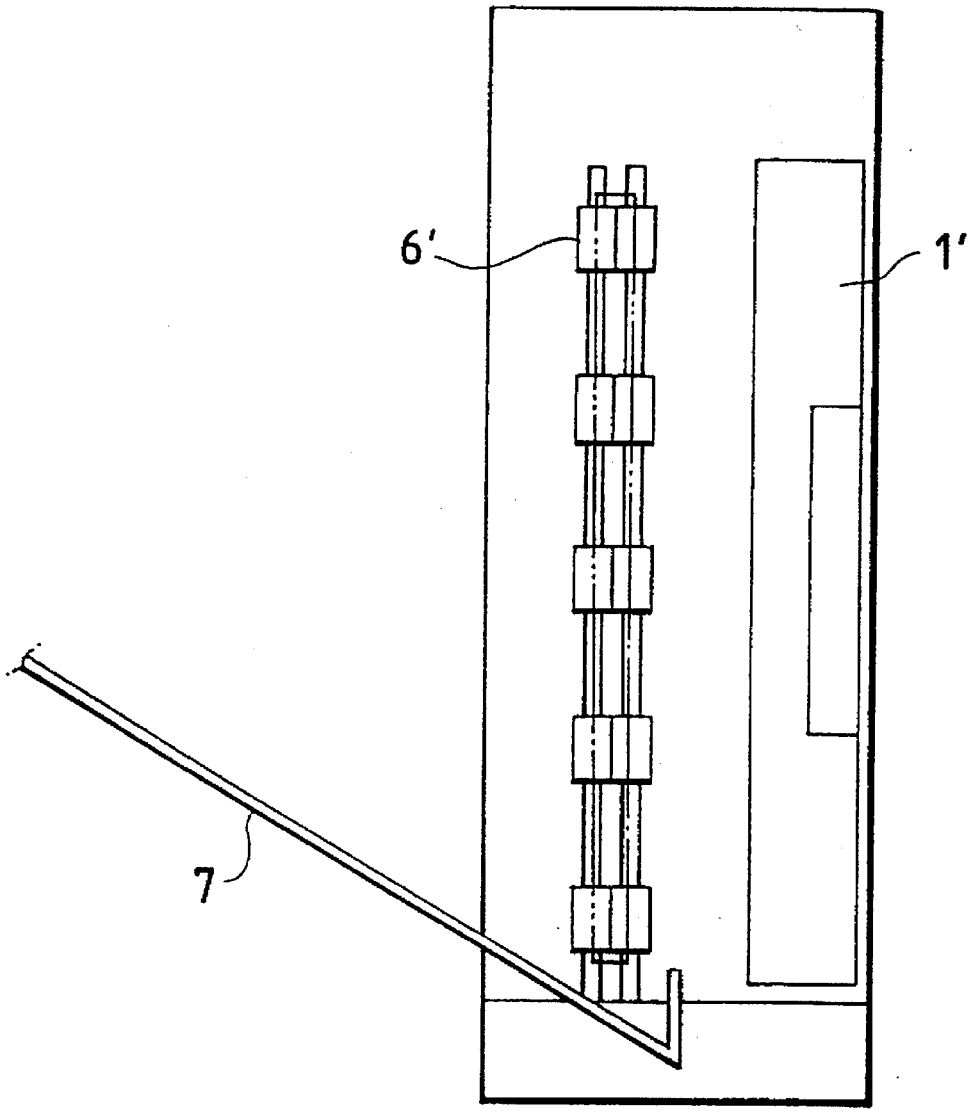
FIG. 11 PRIOR ART
FIG. 11 is an explanatory diagram for explaining the conventional art.

Additionally, the support means 70, unlike the tray 7 for receiving the printed sheets shown in FIG. 11, is constructed so as to support the printed sheets S in a state that these are slanted to the inside of the printer. Therefore, the area occupied by the printer in the installing place is reduced to the extent of the slant of the sheets.

The slanting angle of the support means 70 is selected to have such a value as to prevent the sheet S from slipping down from the support means 70 when the printer is laid down. Therefore, the printer may be used in a state that it is laid down.

2nd Embodiment

Figure 5:
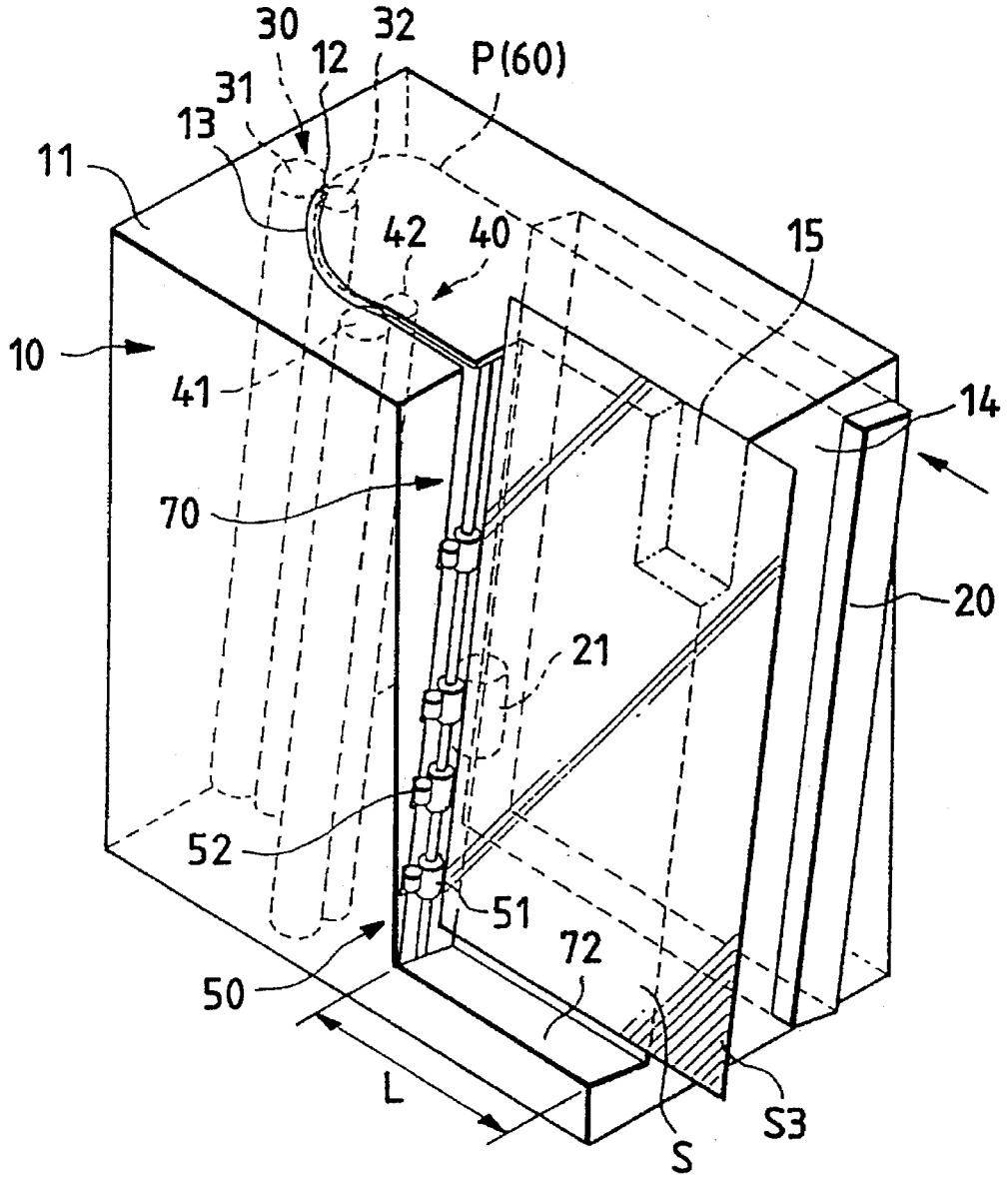
FIG. 5 is a perspective view showing an image forming apparatus according to a second embodiment of the present invention, the image forming apparatus being expressed in the form of a xerography-basis printer.

FIG. 5 is a perspective view showing an image forming apparatus according to a second embodiment of the present invention, the image forming apparatus being expressed in the form of a xerography-basis printer. In the figure, like or equivalent portions are designated by like reference numerals in the drawings used for explaining the first embodiment.

In the xerography-basis printer of the second embodiment, the combination of the paper feeding roller 21, the image forming means 30, and the fixing means 40 is located more downstream (when viewed in the sheet transporting direction) than in the printer of the first embodiment. Most part of the paper cassette 20 is located within the case 10. Further, in the second embodiment, the length L of the support means 70 is shorter than in the first embodiment.

The unique structure of the second embodiment makes the printer more compact.

The image forming means 30 is located at the reversing position of the sheet. The photoreceptor drum 31 is located outside the reversing position. The fixing roller 41 of the fixing means 40 is also located outside the reversing position. A toner image that is formed on the photoreceptor drum 31 is transferred onto the upper surface of the sheet being transported in a slanted state. Because of this, the toner image is little disturbed as stated above. The support means 70 supports the sheets in a called face-up state.

The length L of the support means 70 is shorter than the length of the sheet when viewed in the sheet transporting direction. Accordingly, the front side S3 of the sheet supported by the support means 70 is protruded from the front panel 14 of the case 10. The user easily takes up the front side or sides S3 of the discharged sheet-or sheets between his fingers.

The length L of the support means 70 may be shorter than the length of the sheet of B5 size when viewed in the sheet transporting direction, in consideration of using the sheets of B5 size.

The corner of the case 10 where the ceiling plate 11 intersects the front panel 14 is cut out to form a cutout portion 15. The cutout makes it easy for the user to take up the printed sheet or sheets. In this case, the user inserts his finger into the cutout portion 15 to pinch the front upper corner of the sheet or sheets with his fingers. The provision of the cutout is applicable to the printer of the first embodiment, as a matter of course.

3rd Embodiment

Figure 6:
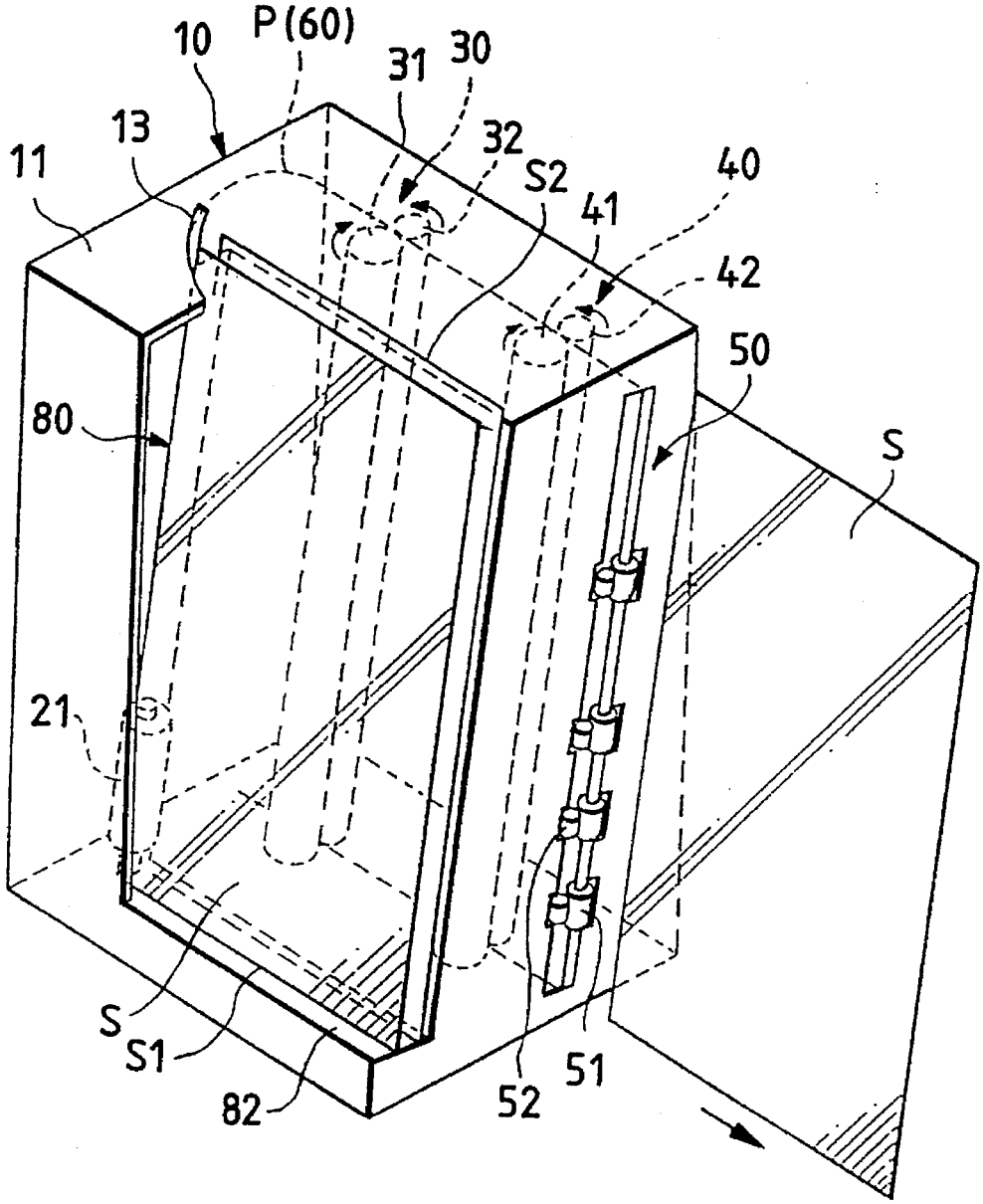
FIG. 6 is a perspective view showing an image forming apparatus according to a third embodiment of the present invention, the image forming apparatus being expressed in the form of a xerography-basis printer.

FIG. 6 is a perspective view showing an image forming apparatus according to a third embodiment of the present invention, the image forming apparatus being expressed in the form of a xerography-basis printer.

The sheet transporting direction in the third embodiment is reverse to that in the first embodiment. The remaining construction is substantially the same as that of the first embodiment. Accordingly, in FIG. 6, like or equivalent portions are designated by like reference numerals in the drawings used for explaining the first embodiment, for simplicity.

Paper supply/support means 80 -is provided in the portion where the support means 70 is provided in the case 10 in the first embodiment.

The paper supply/support means 80 includes a hopper for urging the sheet S toward the paper feeding roller 21, and springs for urging the hopper (which are not shown but similar to the hopper 22 and the compressed springs 23). With the structure, sheets are fed to the printer sheet by sheet.

In the printer of the third embodiment, sheets are transported in the direction that is reverse to the sheet transporting direction in the printer of the first embodiment. During the course of the sheet transportation, a toner image is formed and transferred onto the sheet by the image forming means 30, and fixed by the fixing means 40, and the thus printed sheet is discharged outside the case by the paper discharging means 50.

The sheet is set on the paper supply/support means 80 in a state that the upper side S2 of the sheet is above the ceiling plate 11 of the case 10. Accordingly, the user may easily set the sheet to the paper supply/support means 80 by pinching the upper side of the sheet with his fingers.

When the sheets S are set on the paper supply means, the lower edge S1 of the sheets S are brought into contact with the lower-edge support 82 and automatically trued up. This eliminates the user's work to true up the edges of the sheets.

Also in the third embodiments, the slanting angle of the related means are equal to that of the corresponding means in the first embodiment. Accordingly, the printer of the third embodiment may be used in a state that it is laid down.

While there has been described what is at present considered to be the preferred embodiments of the invention, it will be understood that various modifications may be made therein, and it is intended to cover in the appended claims all such modifications as fall within the true spirit and scope of the invention.

The image forming means in the image forming apparatus employs the xerography-basis image forming process in which an image on an original document is transformed into a toner image. If required, the image forming means may be an image forming process using a wire dot head, an ink jet head, or a thermal head.

What is claimed is:

1. An image forming apparatus comprising:

image forming means for forming an image on a sheet;

paper feeding means for feeding the sheet to said image forming means;

paper discharging means for discharging the sheet having the image formed thereon by said image forming means; and a sheet guide for guiding the sheet;

wherein said image forming means, said paper feeding means, said paper discharging means and said sheet guide are all slanted from the vertical direction.

2. An image forming apparatus comoprising:

image forming means for forming a toner image on a sheet;

paper feeding means for feeding a sheet to said image forming means;

fixing means for fixing the formed toner image onto the sheet;

paper discharging means for discharging the sheet having the toner image fixed thereon by said fixing means; and a sheet guide for guiding the sheet in a state that said sheet guide is in contact with the reverse side of the sheet having no toner image;

wherein said image forming means, said paper feeding means, said fixing means, said paper discharging means, and said sheet guide are all slanted from the vertical direction.

3. The image forming apparatus according to claim 1, wherein the sheet is fed to the rear side of said image forming apparatus by said paper feeding means, is reversed while being guided by said sheet guide, and discharged from the front side of said image forming apparatus by said paper discharging means.

4. The image forming apparatus according to claim 3, further comprising: support means for supporting the printed sheet discharged from said paper discharging means in a state that the sheet is slanted to the inside of said image forming apparatus from the vertical direction.

5. The image forming apparatus according to claim 4, wherein said image forming means, said paper feeding means, said paper discharging means and said sheet guide are put in a box-like case and said support means is formed by the side portion of the case.

6. The image forming apparatus according to claim 4, wherein said image forming means, said paper feeding means, said paper discharging means and said sheet guide are put in a box-like case, the upper side of a sheet transporting path for the sheet guided by said sheet guide intersects the ceiling plate of the case, a releasing slit is provided downstream of the intersection of the ceiling plate when viewed in the sheet transporting direction, said support means includes a lower-edge support for supporting the lower edge of the sheet discharged by said paper discharging means, and the upper surface of the lower-edge support is positioned at a level higher than the lower edge of the sheet to be fed by said paper feeding means.

7. The image forming apparatus according to claims 4, wherein the slanting angle of said support means is selected to have such a value as to prevent the sheet from slipping down from said support means when said image-forming apparatus is laid down.

8. The image forming apparatus according to claim 3, wherein said image forming means, said paper feeding means, said paper discharging means, and said sheet guide are put in a box-like case, the ceiling plate of the case intersects the upper side of a sheet transporting path for the sheet guided by said sheet guide, a releasing slit is provided upstream of the intersection of the ceiling plate when viewed in the sheet transporting direction, and paper supply/support means for supporting sheets to be fed by said paper feeding means in a state that the sheet is slanted to the inside of said image forming apparatus, from the vertical direction.

9. The image forming apparatus according to claim 8, wherein said support means is formed by the side portion of the case.

10. The image forming apparatus according to claim 8, wherein the slanting angle of said supply/support means is selected to have such a value as to prevent the sheet from slipping down from said supply/support means when said image forming apparatus is laid down.

11. The image forming apparatus according to claim 1, further comprising: support means for supporting the printed sheet discharged from said paper discharging means in a state that the sheet is slanted to the inside of said image forming apparatus from the vertical direction.

12. The image forming apparatus according to claim 11, wherein said image forming means, said paper feeding means, said paper discharging means and said sheet guide are put in a box-like case and said support means is formed by the side portion of the case.

13. The image forming apparatus according to claim 11, wherein said image forming means, said paper feeding means, said paper discharging means and said sheet guide are put in a box-like case, the upper side of a sheet transporting path for the sheet guided by said sheet guide intersects the ceiling plate of the case, a releasing slit is provided downstream of the intersection of the ceiling plate when viewed in the sheet transporting direction, said support means includes a lower-edge support for supporting the lower edge of the sheet discharged by said paper discharging means, and the upper surface of the lower-edge support is positioned at a level higher than the lower edge of the sheet to be fed by said paper feeding means.

14. The image forming apparatus according to claims 11, wherein the slanting angle of said support means is selected to have such a value as to prevent the sheet from slipping down from said support means when said image forming apparatus is laid down.

15. The image forming apparatus according to claim 2, wherein the sheet is fed to the rear side of said image forming apparatus by said paper feeding means, is reversed while being guided by said sheet guide, and discharged from the front side of said image forming apparatus by said paper discharging means.

16. The image forming apparatus according to claim 15, further comprising: support means for supporting the printed sheet discharged from said paper discharging means in a state that the sheet is slanted to the inside of said image forming apparatus from the vertical direction.

17. The image forming apparatus according to claim 16, wherein said image forming means, said paper feeding means, said paper discharging means and said sheet guide are put in a box-like case and said support means is formed by the side portion of the case.

18. The image forming apparatus according to claim 16, wherein said image forming means, said paper feeding means, said paper discharging means and said sheet guide are put in a box-like case, the upper side of a sheet transporting path for the sheet guided by said sheet guide intersects the ceiling plate of the case, a releasing slit is provided downstream of the intersection of the ceiling plate when viewed in the sheet transporting direction, said support means includes a lower-edge support for supporting the lower edge of the sheet discharged by said paper discharging means, and the upper surface of the lower-edge support is positioned at a level higher than the lower edge of the sheet to be fed by said paper feeding means.

19. The image forming apparatus according to claim 15, wherein said image forming means, said paper feeding means, said paper discharging means, and said sheet guide are put in a box-like case, the ceiling plate of the case intersects the upper side of a sheet transporting path for the sheet guided by said sheet guide, a releasing slit is provided upstream of the intersection of the ceiling plate when viewed in the sheet transporting direction, and paper supply/support means for supporting sheets to be fed by said paper feeding means in a state that the sheet is slanted to the inside of said image forming apparatus, from the vertical direction.

20. The image forming apparatus according to claim 19, wherein said support means is formed by the side portion of the case.

21. The image forming apparatus according to claim 19, wherein the slanting angle of said supply/support means is selected to have such a value as to prevent the sheet from slipping down from said supply/support means when said image forming apparatus is laid down.

22. The image forming apparatus according to claim 2, further comprising: support means for supporting the printed sheet discharged from said paper discharging means in a state that the sheet is slanted to the inside of said image forming apparatus from the vertical direction.

23. The image forming apparatus according to claim 22, wherein said image forming means, said paper feeding means, said paper discharging means and said sheet guide are put in a box-like case and said support means is formed by the side portion of the case.

24. The image forming apparatus according to claim 22, wherein said image forming means, said paper feeding means, said paper discharging means and said sheet guide are put in a box-like case, the upper side of a sheet transporting path for the sheet guided by said sheet guide intersects the ceiling plate of the case, a releasing slit is provided downstream of the intersection of the ceiling plate when viewed in the sheet transporting direction, said support means includes a lower-edge support for supporting the lower edge of the sheet discharged by said paper discharging means, and the upper surface of the lower-edge support is positioned at a level higher than the lower edge of the sheet to be fed by said paper feeding means.

* * * * *